United States Patent [19]

Young

[11] 4,302,282

[45] Nov. 24, 1981

[54] METHOD OF AND APPARATUS FOR MAKING IMPRINTED PAPER

[75] Inventor: Terrill A. Young, Cincinnati, Ohio

[73] Assignee: The Procter & Gamble Company, Cincinnati, Ohio

[21] Appl. No.: 116,429

[22] Filed: Jan. 29, 1980

[51] Int. Cl.[3] ..... D21F 5/02

[52] U.S. Cl. ..... 162/111; 162/206; 162/281; 162/359

[58] Field of Search ..... 162/112, 205, 206, 281, 162/359, 111, 113

[56] References Cited

U.S. PATENT DOCUMENTS 3,891,500 6/1975 Kankaanpaa ..... 162/354
3,994,771 11/1976 Morgan et al. ..... 162/113

FOREIGN PATENT DOCUMENTS 2626298 12/1976 Fed. Rep. of Germany ..... 162/359

*Primary Examiner*—William F. Smith
*Attorney, Agent, or Firm*—Thomas J. Slone; Fredrick H. Braun; Richard C. Witte

[57] ABSTRACT

An improved method of making imprinted paper on a Yankee dryer type papermaking machine wherein a substantial length portion of a loop of imprinting fabric post-wraps an arcuate sector of the Yankee dryer immediately after a pressure roll-Yankee dryer nip, and by being tensioned imposes radially inwardly acting compressive loading on a corresponding length portion of the web disposed between the fabric and the dryer surface. This enables, for instance, improved Yankee dryer speed, improved web tension and edge control of the paper when creped off the Yankee dryer, reduced use of adhesive on the Yankee dryer surface, improved fiber transfer efficiency, and reduced energy consumption per ton of paper made.

6 Claims, 2 Drawing Figures

METHOD OF AND APPARATUS FOR MAKING IMPRINTED PAPER

TECHNICAL FIELD

This invention relates to papermaking processes and particularly to papermaking processes utilizing a foraminous forming fabric, thermal predrying of the paper web and a Yankee drum dryer.

In the operation of papermaking processes utilizing a Yankee drum dryer, it is desirable to form a thermally conductive seal between a fibrous paper web and the Yankee dryer surface to enhance heat transfer and drying. To do so, it is desirable to have a consistent bond between the Yankee dryer surface and the web. More consistent bonding of the web to the Yankee dryer surface provided by the present invention allows for higher machine speeds with greater edge control and higher web tensions.

BACKGROUND ART

The background art shows examples of papermaking processes utilizing a foraminous forming fabric, thermal predrying of the fibrous web, and a prewrap of the Yankee dryer with the web prior to imprinting effected between a pressure roll and a Yankee drum dryer. Examples of these can be seen in U.S. Pat. No. 3,301,746 issued to L. H. Sanford et al. on Jan. 31, 1967; U.S. Pat. No. 3,994,771 issued to G. Morgan, Jr. et al. on Nov. 30, 1976; and U.S. Pat. No. 3,926,716 issued to G. A. Bates on Dec. 16, 1975.

U.S. Pat. No. 4,102,737 issued to W. J. Morton on July 25, 1978 discloses a papermaking process using a foraminous forming fabric, predrying of a web on the foraminous forming fabric, and pretensioning of a forming fabric against the Yankee dryer prior to running through the nip of a pressure roll and the Yankee dryer surface.

Papermaking processes using a papermaking felt and two rolls pressing the felt two separate times against the Yankee dryer are disclosed in U.S. Pat. No. 3,691,010 issued to K. A. Krake on Sept. 12, 1972 and U.S. Pat. No. 3,560,333 issued to D. C. Douglas et al. on Feb. 2, 1971. In U.S. Pat. No. 2,209,758 issued to E. E. Berry on July 30, 1940, a papermaking process utilizing a papermaking felt is taught where the felt is contacted with a Yankee dryer drum in the nip of the drum with a pressure roll and the felt is postwrapped around the Yankee dryer drum.

In U.S. Pat. No. 3,526,574 issued to E. D. Bleacher et al. on Sept. 1, 1970, a process to make delicate papers is disclosed utilizing a papermaking felt and a Yankee dryer. In Bleacher, the papermaking felt forms a sandwich against the Yankee dryer containing the paper web either prior to running through the nip of the pressure roll or after running through the nip between the Yankee dryer and the pressure roll.

A papermaking process showing a papermaking felt running through the nip of a first pressure roll and a Yankee dryer, wrapped around the surface of a Yankee dryer and run through the nip of a second pressure roll and a Yankee dryer is disclosed in U.S. Pat. No. 1,695,972 issued to E. A. Öhlin et al. on Dec. 18, 1928 and U.S. Pat. No. 3,891,500 issued to Kankaanpää on June 24 1975.

SUMMARY OF THE INVENTION

In accordance with the invention disclosed herein, the invention is a method of manufacturing paper comprising a first step of forming an uncompacted paper web on a foraminous fabric and dewatering the uncompacted paper web to a fiber consistency of at least 30% fiber by weight. An adhesive is applied to the surface of the Yankee dryer. The drying fabric carrying the web imprints the web on the Yankee dryer surface by running through the nip of a pressure roller and a Yankee dryer surface. The fabric runs with the Yankee dryer with the web interposed therebetween while the web and fabric post-wrap the Yankee after going through the nip of the pressure roll for a period of from about 0.004 to about 0.714 seconds. Subsequently, the paper web is dried.

The invention also includes a method of manufacturing paper wherein a first moist fibrous web is formed on a foraminous support medium and at least one other fibrous web is superimposed on the first fibrous web to form a stratified web. The stratified web is transferred from the foraminous support medium to a foraminous drying fabric and dewatered to a fiber consistency of at least 30%. An adhesive is applied to the surface of a Yankee dryer and subsequently the foraminous forming fabric and stratified web pass through the nip of a pressure roll means and the surface of the Yankee dryer wherein the stratified web is transferred to the Yankee dryer surface. The foraminous fabric wraps the surface of the Yankee dryer with the stratified web interposed therebetween with the Yankee dryer drum for a period of from about 0.004 to about 0.714 seconds. The stratified web is then dried on the Yankee dryer and, desirably, creped therefrom.

The invention also includes an improved apparatus of the type wherein a web is wet formed on a forming means and forwarded to a cylindrical dryer drum on an imprinting carrier fabric loop without being subjected to substantial compacting. The imprinting fabric is biased with substantial force by a pressure roll towards the cylindrical dryer drum forming a nip with the cylindrical dryer drum. The web is transferred to the cylindrical dryer drum and adhered thereto by a moisture and pressure responsive adhesive on the drum. The apparatus includes a tension means to bias a substantial length portion of the imprinting carrier fabric loop radially inward towards a substantial arcuate sector of the dryer drum immediately adjacent and downstream from the nip with the web disposed between the fabric and the dryer drum surface.

DETAILED DESCRIPTION OF THE INVENTION

The present invention is an improved method of manufacturing imprinted paper which improves the ability to maintain greater post-crepe web tension and edge control on papermaking machines of the type wherein a paper web is forwarded on an imprinting fabric to a creping/drying cylinder: for instance, A Yankee dryer.

In general, the papermaking process disclosed herein comprises the following steps. A fibrous papermaking furnish is deposited on the foraminous forming fabric to form a web of cellulose fibers. The web is subsequently vacuum dewatered and predried to a fiber consistency of from about 30 to about 90% fibers by weight. Both the fabric and the paper web are run between the nip of a pressure roll and a dryer drum to apply the paper web to a drying surface of the drying drum. Prior to running through the nip between the dryer drum and the pressure roller, glue is applied to the surface of the dryer drum to enable secure adhesion of the web to the dryer drum. After passing between the nip of the pressure roll and the dryer drum, the fabric is wrapped around and runs with the surface of the dryer drum with the paper web sandwiched between the fabric and the dryer drum surface for a period of from about 0.004 to about 0.714 seconds, and preferably a period of from about 0.015 to about 0.096 seconds before the fabric is led away from the surface of the dryer drum, after effecting transfer of the paper web to the dryer surface for drying. The paper web is then substantially dried on the dryer drum. The web is creped off the dryer drum and sent through a calender stack to calender the paper for finished product uses.

The present invention provides partial wrapping of the dryer drum surface by the fabric with the paper web interposed between the fabric and the dryer drum surface which results in several improvements. The partial wrapping of the dryer drum surface produces improved adhesion between the paper web and the dryer drum surface. The improved adhesion results in improved post creping edge control between the doctor blade and the reel by enabling relatively high tension to be maintained between the doctor blade and the reel without peeling the web off of the dryer drum surface before the web reaches the doctor blade. The improved edge control allows improved speed on papermaking machines having edge control limitations. The process disclosed herein also results in lower adhesive usage, improved fiber transfer efficiency, extended creping blade life, and reduced energy consumption per ton of paper made.

Figure 1:
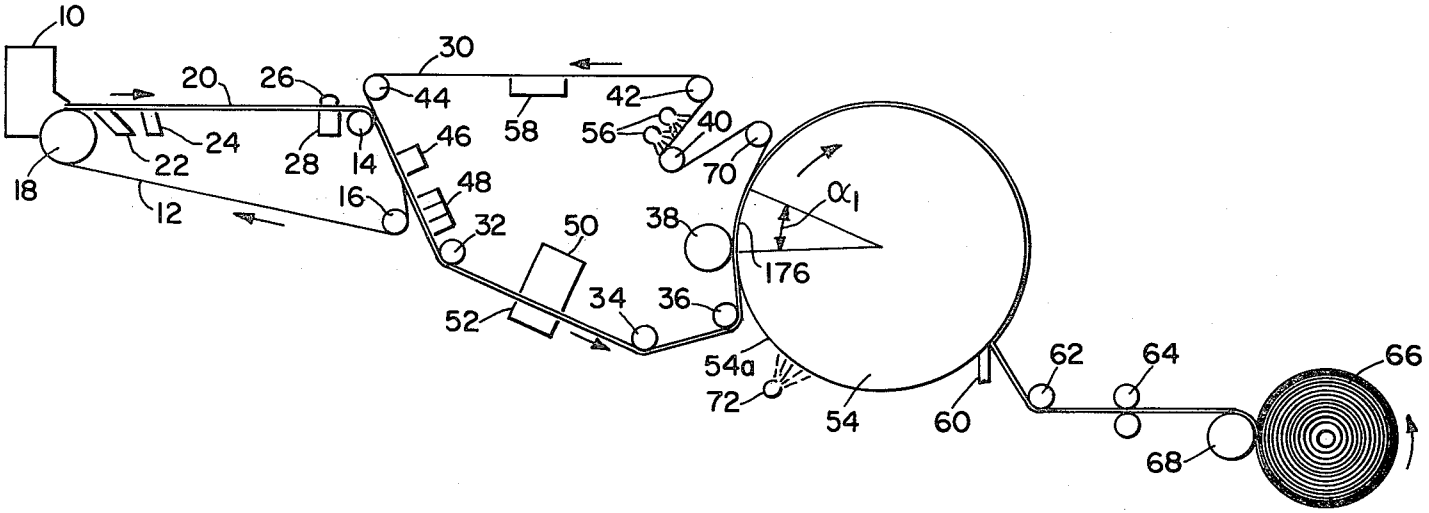
FIG. 1 shows a side elevational schematic view of an apparaus for practicing the method of manufacturing paper according to the present invention.

The process disclosed herein has applications on the papermaking process disclosed in U.S. Pat. No. 3,301,746 issued to L. H. Sanford et al. on Jan. 31, 1967 entitled "Process for Forming Absorbent Paper by Imprinting a Fabric Knuckle Pattern Thereon Prior to Drying and Paper Thereof", hereby incorporated by reference. An exemplary apparatus for practicing the present invention is disclosed in FIG. 1. As seen in FIG. 1, headbox 10 directs a papermaking furnish onto forming wire 12. Forming wire 12 is looped about turn rolls 14, 16 and 18. The furnish forms a papermaking web 20 and is dewatered by dewatering devices 22, 24, steam nozzle 26, and vacuum box 28 to a fiber consistency of about 8 to 20% fiber by weight.

Paper web 20 is transferred from the forming wire 12 to foraminous intermediate drying fabric 30 by a vacuum shoe 46 which applies a differential pressure to transfer the papermaking web 20 from wire 12 to drying fabric 30. Once transferred to the intermediate drying fabric 30, web 20 is dewatered by vacuum boxes 48 and dried by predryers 50 and 52 to attain a web consistency of 30–80% fiber by weight. Intermediate drying fabric turns around rolls 32, 34, 36 and pressure roll 38.

Yankee dryer 54 has glue applied to the surface by glue spray nozzle 72 which supplies glue in a spray having up to 1% solids by weight at a rate of ½ to 4 pounds solids per ton of finished product paper (1.2 to 9.7 kg/metric ton).

The intermediate drying fabric 30 with the paper web 20 disposed thereon transfers the paper web 20 to the Yankee dryer surface 54*a* as the fabric 30 and web 20 pass the nip of the Yankee dryer surface 54*a* and a pressure roll 38. The pressure roll applies a relatively high pressure of 1000–1500 psi (6900–10300 kPa) to the paper web and fabric which precipitates imprinting the web with the knuckle pattern of the fabric and causes the compacted areas of the web to become adhesively secured to the dryer surface. The fabric is wrapped around a substantial arcuate sector or portion of the Yankee surface indicated by angle $\alpha$1, by FIG. 1 being looped about return roll 70. This wrapped sector forms a sandwich of the dryer fabric 30 and Yankee dryer surface 54*a* with the web 20 disposed therebetween so that the web is radially inwardly compressively loaded for a period of from about 0.004 to about 0.714 seconds or for about 0.05 ft. (0.015 m) to about 9.5 ft. (2.90 m) of wrap and preferably from about 0.015 to about 0.096 seconds or about 0.2 ft. (0.06 m) to about 1.3 ft. (0.4 m) of wrap. Fabric 30 applies a pressure of 0.1–0.30 psi (0.7–2.0 kPa). The partial wrap of the Yankee dryer surface after the web passes through the nip with the pressure roll allows time for strong glue bonds to form to securely adhere the web to the Yankee dryer. This provides an improved heat transfer relation from the Yankee dryer to the web and enables applying greater post-creping tension to the web for better web and web-edge control downstream from the creping station.

After the paper web 20 is transferred to the Yankee dryer, intermediate drying fabric 30 is looped about return rolls 70, 40, 42 and 44. Drying fabric 30 is washed by showers 56 to remove excess fiber and dried by vacuum box 58 to be prepared to accept paper web 20.

Paper web 20 runs with the Yankee dryer surface until it is dried to 96–100% fiber by weight and is creped from the Yankee surface by doctor blade 60. Web 20 then goes around straightening roll 62 and through a calender stack 64 to be applied to a reel 66 by roller 68.

EXAMPLE I

A pulp slurry having 0.2% fiber consistency and containing 45% bleached northern softwood kraft and 55% bleached hardwood sulfite was issued from the headbox onto a forming wire. The forming wire was of polyester strands woven with 78 warp and 62 weft strands per inch (30.7 warp and 24.4 weft strands per cm) moving continuously at 800 f.p.m. (244 m/min). Furnish flow and forming wire movement were regulated so that a uniform moist paper web, having a dry basis weight of 14.0 pounds per 3000 square feet (22.88 g/square meter), was formed on the forming wire. The forming devices and the suction box removed water from the web to provide a fiber consistency of 20%. The suction box contacted the underside of the forming wire with a vacuum equivalent to 3 inches of Hg (76 mm of Hg).

A vacuum box 46 created a vacuum of 8 in. Hg. (68 kPa) to effect transfer of the uncompacted web from the forming wire to the intermediate drying fabric. The drying fabric was woven with 31 warp strands per inch (12.2 warp strands per cm) made of 0.0177 inch (0.045 cm) diameter crimped polyester monofilament and 25 weft strands per inch (9.8 weft strands per cm) similar to the warp strands, particularly in that they were crimped to the same degree, with a diameter of 0.0197 inch (0.05 cm). The vacuum shoe operated at 20 in. Hg. (41 kPa) to transfer the web from the forming wire to the intermediate drying fabric. A three section vacuum box having a first compartment which subjected the web to a vacuum of 12 in. Hg. (41 kPa); the second compartment subjected the web to a vacuum of 12 in. Hg. (41 kPa); and the third compartment subjected the web to a vacuum of 10 in. Hg. (34 kPa) to further dewater the web. The web was predried while still on the intermediate drying fabric by thermal predryers. The thermal predryers supplied air at a temperature required to increase the fiber consistency of the web prior to imprinting on the Yankee dryer to about 60%. The drying air was blown through the web and fabric at 290° F. (143° C.).

The intermediate drying fabric with the paper web superimposed thereupon was transferred to the Yankee dryer drum surface as the intermediate drying fabric and web pass the nip of the Yankee dryer drum surface and a pressure roll. The Yankee dryer drum had a diameter of 8 feet (2.43 m). The dried uncompacted web was imprinted with a knuckle pressure at the pressure roll of 1200 pounds/inch$^2$ (8275 kPa) and imprinted the web with the knuckle pattern of the intermediate drying fabric. An adhesive or adhering agent solution was applied by a spray applicator at a point 12 inches (30.5 cm) upstream of the nip between the pressure roll and the surface of Yankee dryer drum and it was applied in a pattern which extends circumferentially on the surface of Yankee dryer drum about 3 to 4 inches (7.6–10.2 cm). The adhering agent used was a partially hydrolyzed polyvinyl alcohol (the degree of hydrolysis is about 88%). The agent was applied as a 0.25% by weight aqueous solution at a rate of about 1 pound adhering agent (on a dry basis) per ton of paper (on a dry basis) (2.42 Kg/metric ton). This adhesive in fact partially dries on the Yankee and then is fully reactivated by the moisture in the web as the pressure-roll-biased fabric compacts areas of the web against the dryer surface.

The Yankee dryer drum was post-wrapped circumferentially by the intermediate drying fabric for a distance of 12 inches immediately adjacent to and downstream from the nip which, when the drum was rotated at a surface velocity of 800 feet per minute provided a compressively loaded sandwiched relation for the web for a period of about 0.075 seconds from the pressure roll Yankee dryer drum nip. The wrap was accomplished by placing a 4 inch (10.2 cm) diameter hollow return roll in the fabric run beyond the pressure roll. The imprinted web was caused to part from the intermediate drying fabric at the pressure nip exit and adhere to the Yankee dryer drum surface by means of the adhesive coat described. The partial wrap of the fabric and web on the Yankee dryer surface, after passing through the nip with the pressure roll allowed time for glue bonds to form between the web and the dryer surface. During the return of the imprinting fabric to the point of contact with the forming wire, it was washed with showers to remove any adhering fiber, and partially dried by means of a vacuum box, operated at a vacuum equivalent to 2 inches of Hg (7 kPa) differential pressure. A roller applicator was used to apply an oil/water emulsion (release agent) to the intermediate drying fabric prior to the point of contact with the web on the forming wire. The emulsion addition and cleaning were necessary to keep the intermediate drying fabric return rolls from becoming coated with fiber and to keep the openings of the intermediate drying fabric free from fiber so that uniform web transfer and release were maintained in this continuous process.

The imprinted paper web adhering to the hot Yankee dryer drum was dried at 800 f.p.m. (243.8 meters per min) to a consistency of 96% fiber by weight and removed from the drum by means of a conventional creping doctor blade. The impact angle between the impact face of the 0.050 inch (0.13 cm) thick doctor blade and the tangent to the Yankee dryer drum at its contact was 81°. Drying on the Yankee dryer drum was accomplished by heating the drum with steam at 120 p.s.i.g. (827 kPa) while impinging air radially inwardly against the web at 300° F. (149° C.) and removing it with a conventional air hood at the rate of 900 pounds air per square foot (4400 Kg/m$^2$) of hood area per hour over approximately one half of the circumference of the dryer, while the imprinted web contacted about three quarters of the dryer circumference.

The dry creped sheet was forwarded from the doctor blade at 700 f.p.m. (214 M/min) by the reel so that the reeled paper had about 13% residual stretch, a basis weight of 14.0 pounds per 3000 square feet (22.8 g/square meter) and 25% imprinted area. The creped paper product formed by this method had exceptional utility for use as sanitary tissue. Between the doctor blade and the calender the web was tensioned with a force of 6.7 grams per inch (2.6 g force/cm$^2$) which is roughly double the level of tension that could be maintained in an identical web made without the intermediate drying fabric wrapping the Yankee.

Figure 2:
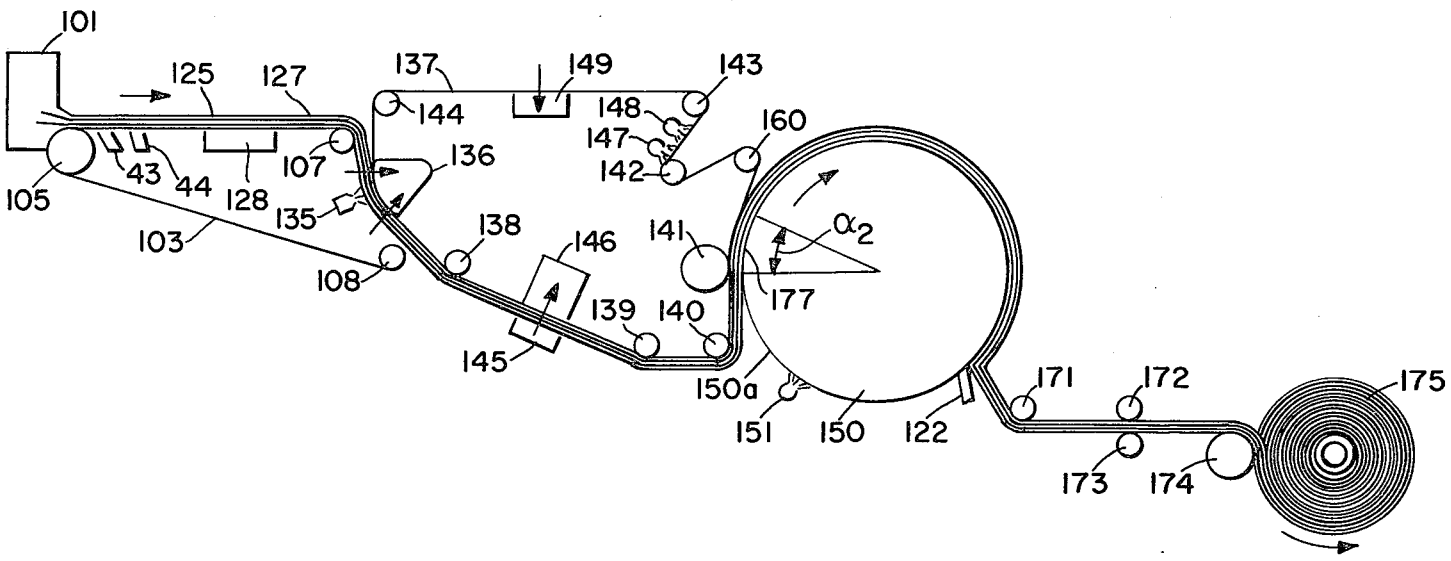
FIG. 2 shows a side elevational view of a second apparatus for practicing the method of manufacturing paper in accordance with the present invention.

The improved, post-wrap method of manufacturing paper of the present invention may also be utilized in the method of making paper as disclosed in U.S. Pat. No. 3,994,771 issued to Morgan, Jr. et al. on Nov. 30, 1976 entitled "Process for Forming a Layered Paper Web Having Improved Bulk, Tactile Impression and Absorbency and Paper Thereof", hereby incorporated by reference. The Morgan method discloses processes to make multiply paper as seen in FIG. 2. A three layer furnish 125 is laid on foraminous forming wire 103 from headbox 101. The outside layers comprise short hardwood fibers and the middle layer comprises long softwood fibers. Forming wire 103 turns around breast roll 105 and return roll 107 and 108. The fiber furnish 125 is dewatered to 8–20% fiber by weight by forming devices 113 and 114, and vacuum box 118 to form stratified web 127. As forming wire 103 turns over roll 107, it is juxtaposed adjacent the intermediate drying fabric 137. Vacuum shoe 136 and steam box 135 provide a force of 20 in. Hg. (68 kPa) to transfer the stratified web 127 to the surface of intermediate drying fabric 137 while drying the web to 15–25% fiber by weight. The transfer of the stratified web 127 to the intermediate drying fabric 137 reorients the short fibers to penetrate the interstices of the intermediate drying fabric 137. Intermediate drying fabric 137 turns around roll 138, 139, 140 to pressure roller 141. Stratified web 127 is partially predried to 30–80% fiber by weight by predryers 145 and 146 which blow hot air through the web to further dewater and partially predry stratified web 127.

The surface of Yankee dryer drum 150 is sprayed with glue by shower 151. Shower applies ½ to 4 pounds of glue per dried ton (1.2–9.7 Kg/metric ton) of paper. The glue applied is up to 1% glue solids and water. The preferred glue for use here is partially hydrolyzed polyvinyl alcohol.

Stratified web 127 is transferred to the surface of Yankee dryer drum 150 at the pressure nip of pressure roll 141 and the Yankee dryer surface 150*a*. The intermediate drying fabric 137 rotates with the Yankee dryer drum surface for about 0.004 to about 0.714 seconds and preferably about 0.015 to about 0.096 seconds. The fabric is wrapped about the Yankee drum dryer surface for about 0.05 feet to about 9.5 feet, and preferably about 0.2 to 1.28 feet, after passing through the nip of the pressure roll over surface 177 defined by radiant angle $\alpha 2$. The pressure roll 141 applies a knuckle pressure of 1000–1500 psi (6900–10340 kPa) in the nip with the Yankee dryer drum surface. The intermediate drying fabric 137 imprints paper web 127 onto the surface 150*a* of Yankee dryer drum 150. The intermediate drying fabric 137 is biased to partially wrap the Yankee dryer drum surface 150*a* with web 127 interposed therebetween over angle $\alpha 2$ by the position of roll 160. The fabric applies a pressure of about 0.10 to about 0.30 psi (0.7–2.0 kPa) to the web pressed against the Yankee.

As can be seen in FIG. 2, fabric 137 passes between the nip of pressure roller 141 and Yankee dryer 150 and partially wraps the Yankee until it passes over return roll 160. Partial post-wrap of the Yankee by the intermediate drying fabric 137 and stratified web 127 forms a sandwich of intermediate drying fabric 137 and Yankee drum dryer surface 150*a* with stratified web 127 interposed therebetween. Yankee dryer drum 150 with the stratified web 127 applied thereto rotates to dry stratified web 127 to 96–100% fiber by weight. The stratified web 127 is then creped from the Yankee by doctor blade 122 which functions to break bonds in the tissue web 127 and to crepe it. Web 127 then passes straightening roll 171 to enter the nip of calender rolls 172 and 173 to be wound on reel 175 by roll 174.

After the paper web 127 is transferred to the Yankee dryer drum surface, the intermediate drying fabric 137 rotates around return rolls 160, 142, 143 and 144. The intermediate drying fabric 137 is washed free of returned fibers by showers 147 and 148 and dried by vacuum box 149.

Fabrics which are suitable for use as drying fabrics may have meshes of from 10 to 60 filaments per inch (4 to 24 filaments per centimeter) with openings having a diagonal free span of 0.009–0.054 inches (0.023–0.14 cm).

A preferred moisture and pressure responsive creping adhesive for practicing the present invention is disclosed in U.S. Pat. No. 3,926,716 which issued to G. A. Bates on Dec. 16, 1975, entitled "Transfer and Adherence of Relatively Dry Paper Web to a Rotating Cylindrical Surface," and is hereby incorporated by reference.

In both improved Sanford and improved Morgan methods of manufacturing paper described above, the intermediate drying fabric wraps the dryer drum after passing between the nip of the pressure roll and the Yankee dryer for about 0.004 to about 0.714 seconds and preferably about 0.015 to about 0.096 seconds.

EXAMPLE II

A three channel headbox deposited three fibrous layers on a forming wire. The consistency of the fiber in each headbox section averages about 0.2% fiber by weight. The first and third channels deposited poplar sulfite fibers while the second layer was bleached softwood kraft. The resulting web is 45% bleached northern softwood kraft and 55% sulfite.

The three layer web was laid on a Fourdrinier forming wire of polyester woven filament design with 78 warp and 62 weft strands per inch (30.7 warp and 24.4 weft strands per cm) moving continuously at 800 f.p.m. (244 meters per min). Flow and forming wire movement were regulated so that a uniform moist paper web, having a dry basis of 14.0 pounds per 3000 square feet (22.8 g/square meter) was formed on the forming wire. The forming devices and the suction box removed water from the web to provide a fiber consistency of about 20%. The suction box contacted the underside of the forming wire with a vacuum equivalent to 3 inches of Hg (76 mm of Hg).

The forming wire moved around turn rolls to be juxtaposed adjacent the intermediate drying fabric. A vacuum shoe created a vacuum of 20 (138 kPa) to effect transfer of the uncompacted web from the forming wire to the intermediate drying fabric. The drying fabric was woven with 31 warp strands per inch (12.2 strands per cm) made of 0.0177 inch (0.045 cm) diameter crimped polyester monofilament and 25 weft strands per inch (9.8 strands per cm) crimped polyester filaments with a diameter of 0.0197 inch (0.05 cm). The three stage box further dewatered the web and was adjusted so that the first compartment which affected the web exposed it to a vacuum of 12 in. Hg. (41 kPa), the second compartment exposed the web to a vacuum of 12 in. Hg. (41 kPa) and the third compartment exposed the web to a vacuum of 10 in. Hg. (34 kPa). A thermal dryer supplied air at a temperature required to partially predry the web to 60% by weight fiber prior to imprinting. The particular temperature utilized depends upon the fiber consistency desired to be achieved. A temperature of 290° F. (143° C.) was utilized to achieve the fiber consistency of 60%.

The uncompacted paper web was imprinted on a Yankee dryer drum surface when the intermediate drying and the paper web passed through the nip of a pressure roller and the Yankee dryer drum surface. The Yankee dryer drum had a diameter of 8 feet (2.4 m) and a width of 31 inches (79 cm). The uncompacted web was imprinted with a nip pressure at the pressure roll and the Yankee dryer drum surface of 1000–1500 psi (6900–10300 kPa) to imprint the web with the pattern of the intermediate drying fabric. Adhering agent solution was applied by a spray applicator at a point 12 inches (30.5 cm) upstream of the nip between roll and the Yankee dryer drum and it was applied in a pattern which extends circumferentially on the surface of dryer drum about 3 to 4 inches (7.6–10 cm). The adhering agent used was a partially hydrolyzed polyvinyl alcohol (the degree of hydrolysis is about 88%). The agent was applied as 0.25% by weight aqueous solution at a rate of about 1 pound adhering agent (on a dry basis) per ton (2.42 kg/metric ton) of paper (on a dry basis). The Yankee dryer drum was wrapped circumferentially by the fabric exerting a pressure about 0.25 lb/in$^2$ (1.7 kPa) on the web for a distance of 12 inches (30.5 cm) around and rotating with the Yankee dryer drum surface from the nip with the pressure roll so that the paper web was sandwiched between the Yankee dryer drum surface and the drying fabric for 0.075 seconds of rotation time. The wrap was accomplished by placing a 4 inch (10.0 cm) diameter hollow aluminum roller 160 into the fabric run adjacent the Yankee and above the pressure roll.

The stratified web was caused to part from the intermediate drying fabric upstream of the pressure nip and adhere to the Yankee dryer surface by means of the adhesive coat described. During the return of the intermediate drying fabric to the point of contact with the forming wire, it was washed with showers to remove any adhering fiber, and partially dried by means of a vacuum box, operated at a vacuum equivalent to 2 inches of Hg (7 kPa) differential pressure.

Drying on the Yankee dryer was accomplished by heating the drum with steam at 120 p.s.i.g. (827 kPa) while impinging air against the web at 300° F. (149° C.), and removing it with a conventional air hood at the rate of 900 pounds air per square foot (4400 kg/m$^2$) of hood area per hour over approximately one half of the circumference of the dryer, while the imprinted web contacted three quarters of the dryer circumference. The imprinted paper web adhering to the hot Yankee dryer drum was dried at 800 f.p.m. (244 meters per min) to a consistency of 96% and removed from the drum by means of a conventional creping doctor blade. The angle between the impact face of the 0.050 inch (0.127 cm) thick doctor blade and the tangent to the Yankee at its contact was 81°.

The dry creped sheet was removed from the doctor blade at 700 f.p.m. (214 meters per min) by the reel so that the product had 13% stretch as crepe folds, a basis weight of 14 pounds per 3000 square feet (22.8 g/meter$^2$) and 25% imprinted area. The creped paper product formed had exceptional utility for use as sanitary tissue.

Between the doctor blade and the calender stack, the paper web was tensioned with a force of 7 grams per inch (2.8 g per cm) of width which is roughly three times as much tension as could be maintained without the post-wrap provided by the present invention.

While not wishing to be bound by any one theory, it is believed that in papermaking processes applying glue to the dryer drum surface prior to running the drying fabric and web through the nip of a pressure roller and a dryer drum surface, the pressure roll nip causes areas of high compression in paper under the fabric knuckle areas. As paper under the knuckle areas is substantially the only area to form a bond with the dryer drum surface, the post-wrap allows the knuckle area the time to develop a better bond with the glue that is sprayed on the dryer surface. The pressure roll has a rubber surface and deforms to give localized surface speed changes on the fabric and web in the nip with the dryer drum surface. The post-wrap allows the glue bonds between the paper web and the dryer drum surface to reform after localized disruption in the nip.

It is further believed that the post-wrap of the dryer drum surface by the drying fabric causes the glue to more effectively bond to the paper web and results in more uniform adherence of paper under the knuckle areas of a fabric to the dryer drum surface. More uniform adherence results in a more uniform crepe (i.e., the crepe ridges appear more regularly in the paper) as the paper is creped off the dryer drum surface by a doctor blade. More regular appearance of crepe ridges in the paper requires more web tension between the doctor blade and the calender rolls to stretch the paper to finished product specifications. Greater web tension applied on the paper between the doctor blade and the calender rolls yields greater edge control on the paper creped off the Yankee dryer surface. On machines that are speed limited by edge control problems, this naturally allows for increased running speed with the same edge control.

When post-wrap pressure is applied, the pressure roller exerts a pressure for both the Sanford and Morgan processes of 1000–1500 psi (6900–10340 kPa) on the drying fabric against the Yankee dryer drum surface. A post-wrap method exerts an additional compressive pressure of 0.1–0.3 psi (0.7–2.0 kPa) on the paper web interposed between the Yankee dryer drum surface and the drying fabric after passing through the pressure roll nip.

A number of marked benefits result from post-wrapping the Yankee dryer surface with the drying fabric after the fabric and web pass between the nip of the pressure roll and the Yankee dryer drum surface. At existing machine speeds, there is a reduction in the weave of the paper sheet on the rolling reel and an increase in the measured tension on the sheet between the doctor blade and the calender rolls. The weave is defined as the lateral weave of the paper sheet parallel to the axis of the reel as the paper is rolled onto the reel. Results shown in Table I below show a reduction in the weave of the paper web on the rolling reel wherein the reel is run at 700 f.p.m. (214 meters per minute).

Measured web tension is measured by having a roller mounted between the doctor blade and the calender rolls having transducers mounted on the supports to measure the tension that the paper web exerts on the roller. As can be seen from Table I, the measured web tension achieves a maximum value with a one foot (0.305 meters) post-wrap of the Yankee surface by the drying fabric in both the improved Morgan and improved Sanford processes. In the tables below, the machine ran at 800 ft/min (243.8 meters/min) using both the Sanford and Morgan processes. All processes listed the same 13% crepe.

TABLE I

Web Control Response
(Polyvinyl Alcohol Adhesive Applied At A Rate Of ½#/Ton)

| Condition | Web Control Rank | Weave (Inches) [cm] | Measured Web Tension (g/in) [g/cm] |
|---|---|---|---|
| No Wrap, | | | |
| Imp.* Morgan Process | 4 | ½ [1.27] | 2 [0.79] |
| Imp. Sanford Process | 5 | ½ [1.27] | 3 [1.18] |
| 1' Wrap, [0.305 m] | | | |
| Imp. Morgan Process | 1 | ½ [1.27] | 7 [2.76] |
| Imp. Sanford Process | 2 | ⅜ [0.95] | 6.8 [2.68] |
| 2' Wrap, [0.610 m] | | | |
| Imp. Morgan Process | 3 | ½ [1.27] | 4.25 [1.67] |

*Imp. = Improved

Table II shows measured web tension improvements at a given production machine speed using the Sanford papermaking process. The machine used 94% by weight 88% partially hydrolyzed polyvinyl alcohol/6% by weight a copolymer of styrene and maleic anhydride glue applied to the Yankee drum dryer surface at a rate of 2.0 lb/ton (4.84 kg/metric ton) of finished paper. Each measured web tension is the average of three readings of a modified force gauge reading of the two edges of the web and the middle of the web.

TABLE II

| Amount of Wrap | Measured Web Tension (g/in) [g/cm] |
|---|---|
| 0 | 48 [18.9] |
| 6" | 50.8 [20.0] |
| 12" | 52.5 [20.7] |
| 24" | 54 [21.3] |
| 30" | 57 [22.4] |

Table II shows a marked increase in the overall web tension as the amount of post-wrap is increased.

It is known in the art that higher web tension (as used herein, web tension is defined to be the force required to deflect a web out of its normal running plane) results in improved web and edge control. Poor web control results in poorly wound paper rolls which, in turn, result in poor usability of the paper roll in converting to finished products. Thus, an improvement in web control allows for improved paper rolls which would allow for a speed up in the running of the papermachine to yield a given quality paper roll for use in converting to the finished product.

The resulting speed improvements from use of the post-wrap method as disclosed herein can be seen for production size machines in Table III.

TABLE III

| Method-Improved | % Speed Increase Max. | % Speed Increase Sustained | Circumferential Length of Post Pressure Roll Wrap On The Yankee Dryer |
|---|---|---|---|
| Sanford* | 8.6 | 2.9 | 24 in. [61 cm] |
| Sanford** | 4.0 | 4.0 | 12 in. [30.5 cm] |
| Sanford*** | 2.4 | 0 | 16 in. [40.6 cm] |

Table III shows the maximum percentage increase in speed of 8.6 percent.
*Used 95% by weight partially hydrolyzed polyvinyl alcohol and 5% by weight of a copolymer of styrene and maleic anhyride glue.
**Used 80% by weight of partially hydrolyzed polyvinyl alcohol and 20% by weight of a copolymer of dimethyl and ammonium chloride glue.
***Used 60% by weight of animal hide glue and 40% by weight fully hydrolyzed polyvinyl alcohol glue.

Alternatively, adhesive usage is decreased during running at conventional speeds using a post-wrap as disclosed herein. Because the web is held in intimate contact with the surface of the Yankee dryer for an extended period of time, a better glue bond is formed between the paper fibers and the Yankee dryer surface. Because the better bond is formed, less glue need be applied directly to the Yankee surface to achieve the same bond. Thus, there is a net saving of glue usage for a given rate of paper production.

Aside from allowing increased speed on existing machines, the post-wrap process disclosed herein has shown a positive effect on doctor and cleaning blade life on machines utilizing a Yankee drum dryer. At improved speeds using the improved Sanford process, utilizing a 6" (15.2 cm) post-wrap, there is shown to be a 30% reduction in the use of doctor blades and a 16.5% reduction in the use of cleaning blades.

Furthermore, at increased machine speeds, there is shown to be an increase in the fiber transfer efficiency. As used herein, fiber transfer efficiency is defined as the amount of fiber (expressed as a percent or pounds of fiber per ton (kg/metric ton) of dry paper) in the water that the fabric is washed in after transfer of a paper web onto the Yankee dryer drum. This shower occurs at shower 56 in FIG. 1 and showers 146 and 149 on FIG. 2. The more fiber that is lost in the showerings of the fabric, the less that is incorporated in the paper web. Therefore, the less percentage of fibers lost in the fabric shower water, the better. Tests on both the Sanford and Morgan processes as improved by the present invention at 800 ft/min (244 meters/min) yielded the following maximum reduction in the percent fiber in the fabric shower water: 25% fiber reduction using the improved Sanford process and 12.5% fiber reduction in the improved Morgan process.

It can be readily seen from the above noted figures, post-wrap of the Yankee by the fabric results in a more efficient transfer of fiber from the intermediate drying fabric to the Yankee surface for final drying.

The process disclosed above results in energy savings in both the improved Sanford and improved Morgan papermaking processes. The partial wrap of Yankee dryer drum with the intermediate drying fabric results in improved heat transfer to the paper web from the Yankee dryer surface. The wrap causes a better bond to be formed between the paper web and the dryer surface to yield enhanced heat transfer. This lowers the total energy required to make a ton of paper.

While particular embodiments of the present invention have been illustrated and described, it would be obvious to those skilled in the art that various other changes and modifications can be made without departing from the spirit and scope of the invention. It is intended to cover in the appended claims all such changes and modifications that are within the scope of this invention.

What is claimed and desired to be secured by Letters Patent of the United States is:

1. An improved apparatus for making creped, imprinted paper which apparatus is of the type wherein a web is wet formed on a forming means and then forwarded to a dryer-creping cylinder on an imprinting carrier fabric loop without subjecting the web to substantial compaction prior to reaching the dryer-creping cylinder, and in which apparatus a pressure roll is biased with substantial force towards the dryer-creping cylinder to form a relatively highly pressure biased compressive nip therebetween through which the web backed by the imprinting carrier fabric is forwarded onto the dryer-creping cylinder and adhered thereto with moisture and pressure responsive creping adhesive disposed thereon, said improvement comprising tension means for biasing a substantial length portion of said imprinting carrier fabric loop radially inwardly against a substantial arcuate sector of said dryer cylinder immediately adjacent and downstream from said nip so that a running portion of said web is disposed and relatively lightly compressively biased therebetween without said web being subjected to the compressive action of a second pressure biased nip, said tension means comprising a rotatably mounted turning roll, and means for maintaining a predetermined level of tension in said fabric loop, said turning roll being sufficiently spaced from said dryer cylinder to obviate there being a second pressure biased nip downstream from said nip through which said substantial length portion of said imprinting carrier fabric loop passes.

2. The improved apparatus of claim 1 wherein said means for biasing are adapted to maintain a compressive loading on said running portion of said web in the range of from about 0.1 to about 0.3 psi (0.7 to about 2 kPa), and said substantial length portion is so related to the peripheral velocity of said dryer-creping cylinder that said web is disposed intermediate said imprinting fabric and said dryer-creping cylinder for a period of from about 0.004 to about 0.72 seconds immediately downstream from said nip.

3. The improved apparatus of claim 2 wherein said period is from about 0.015 to about 0.096 seconds.

4. An improved method of continuously forming, forwarding, drying and creping an endless web of paper which method includes imprinting the web under substantial pressure with the knuckle pattern of an endless loop of imprinting fabric by forwarding the web disposed on the fabric through only a single pressure biased nip between a pressure roll and a dryer-creping cylinder, and transferring and adhering the web to the cylindrical surface of the dryer-creping cylinder with moisture and pressure responsive creping adhesive applied thereto upstream from the nip, the improvement comprising the step of tension biasing a substantial length portion of said fabric loop towards an arcuate sector of the dryer-creping cylinder disposed immediately adjacent to and extending downstream from said nip with a corresponding running length portion of the web compressively loaded directly against the surface of the dryer-creping cylinder without subjecting the web to the compressive action of a second pressure biased nip.

5. The method of claim 4 wherein said length portion is sufficiently long with respect to the peripheral velocity of said dryer-creping cylinder that said web is subjected to said compressive loading for a period of from about 0.004 to about 0.72 seconds, and wherein said compressive loading is in the range of from about 0.1 psi to about 0.3 psi.

6. The method of claim 5 wherein said period is from about 0.004 to about 0.096 seconds.

* * * * *